US012163258B2

(12) United States Patent
Morishita et al.

(10) Patent No.: US 12,163,258 B2
(45) Date of Patent: Dec. 10, 2024

(54) CARBON FIBER AND METHOD FOR PRODUCING THE SAME

(71) Applicants: KABUSHIKI KAISHA TOYOTA CHUO KENKYUSHO, Nagakute (JP); TOYOTA JIDOSHA KABUSHIKI KAISHA, Toyota (JP)

(72) Inventors: Takuya Morishita, Nagakute (JP); Mitsumasa Matsushita, Nagakute (JP); Mamiko Narita, Nagakute (JP); Akira Kunitomo, Nagahama (JP); Nozomu Shigemitsu, Nissin (JP); Takanori Tatematsu, Nissin (JP)

(73) Assignees: KABUSHIKI KAISHA TOYOTA CHUO KENKYUSHO, Nagakute (JP); TOYOTA JIDOSHA KABUSHIKI KAISHA, Toyota (JP)

( * ) Notice: Subject to any disclaimer, the term of this patent is extended or adjusted under 35 U.S.C. 154(b) by 315 days.

(21) Appl. No.: 17/587,573

(22) Filed: Jan. 28, 2022

(65) Prior Publication Data

US 2022/0298677 A1 Sep. 22, 2022

(30) Foreign Application Priority Data

Mar. 18, 2021 (JP) ..... 2021-044444

(51) Int. Cl.
*D01F 9/21* (2006.01)

(52) U.S. Cl.
CPC ..... *D01F 9/21* (2013.01)

(58) Field of Classification Search
None
See application file for complete search history.

(56) References Cited

U.S. PATENT DOCUMENTS

| | | | |
|---|---|---|---|
| 2017/0067187 | A1 | 3/2017 | Watanabe et al. |
| 2019/0031800 | A1 | 1/2019 | Morishita et al. |
| 2019/0360127 | A1 | 11/2019 | Nomura et al. |
| 2020/0399789 | A1 | 12/2020 | Okuda et al. |

FOREIGN PATENT DOCUMENTS

| | | | |
|---|---|---|---|
| EP | 3 467 165 | A1 | 4/2019 |
| JP | 37-4405 | A | 6/1962 |
| JP | 2012-82541 | A | 4/2012 |
| JP | 2012-117161 | A | 6/2012 |
| JP | 2013-103992 | A | 5/2013 |
| JP | 2015-74844 | A | 4/2015 |
| JP | 2016-40419 | A | 3/2016 |
| JP | 2016-113726 | A | 6/2016 |
| JP | 2018-90791 | A | 6/2018 |
| JP | 2019-26827 | A | 2/2019 |
| JP | 2019-202924 | A | 11/2019 |
| JP | 2019-203232 | A | 11/2019 |

OTHER PUBLICATIONS

Machine Translation of JP2012117161 (Year: 2012).*
Sep. 7, 2022 Extended European Search Report issued in European Patent Application No. 22154787.0.

* cited by examiner

*Primary Examiner* — Shawn Mckinnon
(74) *Attorney, Agent, or Firm* — Oliff PLC

(57) ABSTRACT

A carbon fiber wherein an average fiber diameter of a single fiber is in a range of 3 to 10 μm, and an average value of an intensity ratio (D/G) of a D peak to a G peak in a Raman spectrum in a cross section perpendicular to a fiber axis direction of the single fiber is 0.90 or less in a region inside a circle having a diameter of 1 μm and centered at a center of gravity of the cross section of the single fiber, and is 0.90 or less in a region up to 1 μm inside from an outer periphery of the cross section of the single fiber, wherein the D peak is observed at around 1360 $cm^{-1}$ and derived from a defect in a graphite structure and the G peak is observed at around 1590 $cm^{-1}$ and derived from the graphite structure.

4 Claims, No Drawings

CARBON FIBER AND METHOD FOR PRODUCING THE SAME

BACKGROUND OF THE INVENTION

Field of the Invention

The present invention relates to a carbon fiber and a method for producing the same.

Related Background Art

As a conventional method for producing a carbon fiber, a method including thermally-stabilizing (flameproofing) a carbon fiber precursor, which is obtained by spinning polyacrylonitrile, and then carbonizing the carbon fiber precursor has mainly been employed (for example, Japanese Examined Patent Application Publication No. Sho37-4405 (PTL 1), Japanese Unexamined Patent Application Publication No. 2015-74844 (PTL 2), Japanese Unexamined Patent Application Publication No. 2016-40419 (PTL 3), and Japanese Unexamined Patent Application Publication No. 2016-113726 (PTL 4)). Since polyacrylonitrile, which is used in this method, is unlikely to be dissolved in an inexpensive general-purpose solvent, it is necessary to use an expensive solvent such as dimethyl sulfoxide or N,N-dimethylacetamide in polymerization and spinning, which brings about a problem of high production costs of carbon fibers.

In addition, Japanese Unexamined Patent Application Publication No. 2013-103992 (PTL 5) describes a carbon material precursor fiber which contains a polyacrylonitrile-based copolymer composed of 96 to 97.5 parts by mass of an acrylonitrile unit, 2.5 to 4 parts by mass of an acrylamide unit, and 0.01 to 0.5 parts by mass of a carboxylic acid-containing vinyl monomer. This polyacrylonitrile-based copolymer contains acrylamide units and carboxylic acid-containing vinyl monomer units that contribute to the water solubility of the polymer, but is insoluble in water because the contents thereof are low, and it is necessary to use an expensive solvent such as N,N-dimethylacetamide in the polymerization and molding process (spinning), and there is a problem that the production cost of a carbon fiber becomes high.

There is also a problem that when polyacrylonitrile or a copolymer thereof is subjected to heating treatment, rapid heat generation occurs and accelerates the thermal decomposition of the polyacrylonitrile or the copolymer thereof, so that the yield of the carbon material (carbon fiber) is lowered. Therefore, when a carbon material (carbon fiber) is produced using polyacrylonitrile or a copolymer thereof, it is necessary to gradually raise the temperature over a long period of time so as not to cause rapid heat generation in the process of raising the temperature in the thermally-stabilizing treatment or the carbonizing treatment.

On the other hand, acrylamide-based polymers containing a large amount of acrylamide units are water-soluble polymers and allow water to be used as a solvent, which is inexpensive and has a small environmental load, during polymerization and molding process (such as film formation, sheet formation, and spinning), and thus it is expected to reduce the production cost of carbon materials. For example, Japanese Unexamined Patent Application Publication No. 2018-90791 (PTL 6) describes a carbon material precursor composition containing an acrylamide-based polymer and at least one additive selected from the group consisting of acids and salts thereof, and a method for producing a carbon material using the same. In addition, Japanese Unexamined Patent Application Publication No. 2019-26827 (PTL 7) describes a carbon material precursor which is composed of an acrylamide/vinyl cyanide-based copolymer containing 50 to 99.9 mol % of an acrylamide-based monomer unit and 0.1 to 50 mol % of a vinyl cyanide-based monomer unit, a carbon material precursor composition which contains this carbon material precursor and at least one additive selected from the group consisting of acids and salts thereof, and a method for producing a carbon material using these.

In addition, Japanese Unexamined Patent Application Publication No. 2012-82541 (PTL 8) describes a method for producing a carbon fiber, including: a thermally-stabilizing step of thermally-stabilizing a polyacrylonitrile-based fiber in the air; a pre-carbonizing step of pre-carbonizing a fiber obtained in the thermally-stabilizing step in an inert atmosphere; and a carbonizing step of carbonizing a fiber obtained in the pre-carbonizing step in an inert atmosphere, and also states that it is possible to obtain a carbon fiber excellent in tensile modulus by applying tension of 4.0 to 35.0 mN/dtex to the fiber in the carbonizing step.

Moreover, Japanese Unexamined Patent Application Publication No. 2019-202924 (PTL 9) describes a method for thermally-stabilizing a carbon material precursor, including a temperature controlling step of performing feedback control for a temperature in a heating device using a water vapor concentration in the heating device as an index in a temperature range between a temperature range in which generation of water vapor is facilitated in the thermally-stabilizing reaction of the carbon material precursor and a temperature range in which generation of water vapor is facilitated in the partial oxidation reaction of the carbon material precursor such that the generation of water vapor in the thermally-stabilizing reaction completes and the generation of water vapor in the partial oxidation reaction is suppressed. PTL 9 also states that by subjecting a thermally-stabilized product obtained by this method to carbonizing treatment under an inert gas atmosphere at a temperature of 1100° C. or more, it is possible to obtain a carbon material having a peak intensity ratio [I(G)/I(D))] of 1.0 or more between G band (wave number: near 1590 $cm^{-1}$) derived from a graphite structure and D band (wave number: near 1350 $cm^{-1}$) derived from a defect structure in the Raman spectrum of the surface of the carbon material.

SUMMARY OF THE INVENTION

However, in the conventional methods for producing a carbon fiber, the tensile strength of the obtained carbon fiber is not necessarily sufficiently high even when a thermally-stabilized fiber of an acrylamide-based polymer fiber is subjected to carbonizing treatment or when a thermally-stabilized fiber of an acrylamide-based polymer fiber is subjected to carbonizing treatment after pre-carbonizing treatment.

The present invention has been made in view of the above-mentioned problems of the related art, and an object thereof is to provide a carbon fiber having excellent tensile strength and a method for producing the same.

The present inventors have made earnest studies to achieve the above object and have consequently found that by subjecting a thermally-stabilized fiber of an acrylamide-based polymer fiber to carbonizing treatment after performing pre-carbonizing treatment while applying a predetermined tension thereto under an inert gas atmosphere, a carbon fiber thus obtained had fewer defects in a graphite structure in both of a center portion and a surface portion in a cross-section of a single fiber thereof, and further found that this carbon fiber was excellent in tensile strength. The present inventors have thus completed the present invention.

Specifically, a carbon fiber of the present invention is a carbon fiber wherein an average fiber diameter of a single fiber is in a range of 3 to 10 μm, and an average value of an intensity ratio (D/G) of a D peak to a G peak in a Raman spectrum in a cross section perpendicular to a fiber axis direction of the single fiber is 0.90 or less in a region inside a circle having a diameter of 1 μm and centered at a center of gravity of the cross section of the single fiber, and is 0.90 or less in a region up to 1 μm inside from an outer periphery of the cross section of the single fiber, wherein the D peak is observed at around 1360 $cm^{-1}$ and derived from a defect in a graphite structure and the G peak is observed at around 1590 $cm^{-1}$ and derived from the graphite structure.

In the carbon fiber of the present invention, it is preferable that the average value of the D/G be 0.85 or less in the region inside the circle having a diameter of 1 μm and centered at the center of gravity of the cross section of the single fiber, and be 0.85 or less in the region up to 1 μm inside from the outer periphery of the cross section of the single fiber.

In addition, a method for producing a carbon fiber of the present invention is a method comprising: a pre-carbonizing treatment step obtaining a pre-carbonized fiber by subjecting a thermally-stabilized fiber of an acrylamide-based polymer fiber to heating treatment at a temperature in a range of 300 to 1000° C. while applying a tension in a range of 0.05 to 4 mN/dtex thereto under an inert gas atmosphere; and a carbonizing treatment step of obtaining a carbon fiber by subjecting the pre-carbonized fiber to heating treatment.

In the pre-carbonizing treatment step, it is preferable that the tension applied to the thermally-stabilized fiber be in a range of 0.15 to 1.5 mN/dtex.

According to the present invention, it is possible to obtain a carbon fiber having excellent tensile strength.

DETAILED DESCRIPTION OF THE PREFERRED EMBODIMENTS

Hereinafter, the present invention is described in detail with reference to preferred embodiments thereof.

A carbon material of the present invention is a carbon fiber wherein an average fiber diameter of a single fiber is in a range of 3 to 10 μm, and an average value of an intensity ratio (D/G) of a D peak to a G peak in a Raman spectrum in a cross section perpendicular to a fiber axis direction of the single fiber is 0.90 or less in a region (center portion) inside a circle having a diameter of 1 μm and centered at the center of gravity of the cross section of the single fiber, and is 0.90 or less in a region (surface portion) up to 1 μm inside from an outer periphery of the cross section of the single fiber, wherein the D peak is observed at around 1360 $cm^{-1}$ and derived from a defect in a graphite structure and the G peak is observed at around 1590 $cm^{1}$ and derived from the graphite structure.

In addition, a method for producing a carbon fiber of the present invention is a method comprising: a pre-carbonizing treatment step of obtaining a pre-carbonized fiber by subjecting a thermally-stabilized fiber of an acrylamide-based polymer fiber to heating treatment at a temperature in a range of 300 to 1000° C. while applying a tension in a range of 0.05 to 4 mN/dtex thereto under an inert gas atmosphere; and a carbonizing treatment step of obtaining a carbon fiber by subjecting the pre-carbonized fiber to heating treatment.

[Method for Producing a Carbon Fiber]

First, an acrylamide-based polymer, an acrylamide-based polymer fiber, and a thermally-stabilized fiber of the acrylamide-based polymer fiber which are used in the present invention are described.

(Acrylamide-Based Polymer)

The acrylamide-based polymer used in the present invention may be a homopolymer of an acrylamide-based monomer or a copolymer of an acrylamide-based monomer and an additional polymerizable monomer, and a copolymer of an acrylamide-based monomer and an additional polymerizable monomer is preferable from the viewpoints that the tensile strength of the carbon fiber is improved and the carbonization yield is improved.

From the viewpoint that the solubility of the copolymer in an aqueous solvent or a water-based mixture solvent is improved, the lower limit of the content of the acrylamide-based monomer units in the copolymer of an acrylamide-based monomer and an additional polymerizable monomer is preferably 40 mol % or more, more preferably 50 mol % or more, further preferably 55 mol % or more, and particularly preferably 60 mol % or more. In addition, from the viewpoints that the tensile strength of the carbon fiber is improved and the carbonization yield is improved, the upper limit of the content of the acrylamide-based monomer units is preferably 99.9 mol % or less, more preferably 99 mol % or less, further preferably 95 mol % or less, particularly preferably 90 mol % or less, and most preferably 85 mol % or less.

From the viewpoints that the tensile strength of the carbon fiber is improved and the carbonization yield is improved, the lower limit of the content of the additional polymerizable monomer units in the copolymer of the acrylamide-based monomer and an additional polymerizable monomer is preferably 0.1 mol % or more, more preferably 1 mol % or more, further preferably 5 mol % or more, particularly preferably 10 mol % or more, and most preferably 15 mol % or more. In addition, from the viewpoint that the solubility of the copolymer in an aqueous solvent or a water-based mixture solvent is improved, the upper limit of the content of the additional polymerizable monomer units is preferably 60 mol % or less, more preferably 50 mol % or less, further preferably 45 mol % or less, and particularly preferably 40 mol % or less.

The acrylamide-based monomer includes, for example, acrylamide; N-alkylacrylamides such as N-methylacrylamide, N-ethylacrylamide, N-n-propylacrylamide, N-isopropylacrylamide, N-n-butylacrylamide, N-tert-butylacrylamide, and N-hexylacrylamide; N-cycloalkylacrylamides such as N-cyclohexylacrylamide; dialkylacrylamides such as N,N-dimethylacrylamide; dialkylaminoalkyl acrylamide such as dimethylaminoethyl acrylamide and dimethylaminopropyl acrylamide; hydroxyalkylacrylamides such as N-(hydroxymethyl)acrylamide and N-(hydroxyethyl)acrylamide; N-arylacrylamides such as N-phenylacrylamide; diacetone acrylamide; N,N'-alkylene bisacrylamide such as N,N'-methylene bisacrylamide; methacrylamide; N-alkyl methacrylamides such as N-methyl methacrylamide, N-ethyl methacrylamide, N-n-propyl methacrylamide, N-isopropyl methacrylamide, N-n-butyl methacrylamide, N-tert-butyl methacrylamide, and N-hexyl methacrylamide; N-cycloalkyl methacrylamides such as N-cyclohexyl methacrylamide; dialkyl methacrylamides such as N,N-dimethyl methacrylamide; dialkylaminoalkyl methacrylamides such as dimethylaminoethyl methacrylamide and dimethylaminopropyl methacrylamide; hydroxyalkyl methacrylamides such as N-(hydroxymethyl)methacrylamide and N-(hydroxyethyl)

methacrylamide; N-arylmethacrylamide such as N-phenylmethacrylamide; diacetone methacrylamide; N,N'-alkylene bismethacrylamide such as N,N'-methylene bismethacrylamide; crotonamide; maleic acid monoamide; maleamide; fumaric acid monoamide; fumaramide; mesaconic amide; citraconic amide; itaconic acid monoamide; and itaconic diamide. One of these acrylamide-based monomers may be used solely or two or more of these may be used in combination. In addition, among these acrylamide-based monomers, acrylamide, N-alkylacrylamide, dialkylacrylamide, methacrylamide, N-alkyl methacrylamide, and dialkyl methacrylamide are preferable, and acrylamide is particularly preferable, from the viewpoint that these acrylamide-based monomers have high solubilities into the aqueous solvent or the water-based mixture solvent.

Examples of the additional polymerizable monomer include vinyl cyanide-based monomers, unsaturated carboxylic acids and salts thereof, unsaturated carboxylic acid anhydrides, unsaturated carboxylic acid esters, vinyl-based monomers, and olefin-based monomers. Examples of the vinyl cyanide-based monomers include acrylonitrile, methacrylonitrile, 2-hydroxyethylacrylonitrile, chloroacrylonitrile, chloromethylacrylonitrile, methoxyacrylonitrile, methoxymethylacrylonitrile, and vinylidene cyanide. Examples of the unsaturated carboxylic acids include acrylic acid, methacrylic acid, maleic acid, fumaric acid, itaconic acid, citraconic acid, mesaconic acid, crotonic acid, and isocrotonic acid, examples of the salt of the unsaturated carboxylic acids include metal salts of the unsaturated carboxylic acids (such as sodium salts and potassium salts), ammonium salts, and amine salts, examples of the unsaturated carboxylic acid anhydrides include maleic anhydride and itaconic anhydride, examples of the unsaturated carboxylic acid esters include methyl acrylate, methyl methacrylate, 2-hydroxyethyl acrylate, and 2-hydroxyethyl methacrylate, examples of the vinyl-based monomers include aromatic vinyl-based monomers such as styrene and α-methylstyrene, vinyl chloride, and vinyl alcohol, and examples of the olefin-based monomers include ethylene and propylene. These additional polymerizable monomers may be used alone or in combination of two or more kinds. In addition, among these additional polymerizable monomers, vinyl cyanide-based monomers are preferable, and acrylonitrile is particularly preferable from the viewpoints that the spinnability of the acrylamide-based polymer and the carbonization yield are improved, unsaturated carboxylic acids and salts thereof are preferable from the viewpoint that the solubility of the copolymer in an aqueous solvent or a water-based mixture solvent is improved, and unsaturated carboxylic acids and unsaturated carboxylic acid anhydrides are preferable, and acrylic acid, maleic acid, fumaric acid, itaconic acid, and maleic anhydride are more preferable from the viewpoint that the fusion prevention property of the single fibers during the thermally-stabilizing treatment is improved.

The upper limit of the weight average molecular weight of the acrylamide-based polymer used in the present invention is not particularly limited, but is usually 5,000,000 or less, and from the viewpoint that the spinnability of the acrylamide-based polymer is improved, it is preferably 2,000,000 or less, more preferably 1,000,000 or less, further preferably 500,000 or less, even further preferably 300,000 or less, particularly preferably 200,000 or less, even particularly preferably 130,000 or less, and most preferably 100,000 or less. In addition, the lower limit of the weight average molecular weight of the acrylamide-based polymer is not particularly limited, but is usually 10,000 or more, and from the viewpoints that the strengths of the acrylamide-based polymer fiber, thermally-stabilized fiber and carbon fiber are improved, it is preferably 20,000 or more, more preferably 30,000 or more, and particularly preferably 40,000 or more. The weight average molecular weight of the acrylamide-based polymer is measured by using gel permeation chromatography.

In addition, the acrylamide-based polymer used in the present invention is preferably soluble in at least either of an aqueous solvent (water, alcohol, and the like, and a mixed solvent thereof) and a water-based mixture solvent (a mixed solvent of the aqueous solvent and an organic solvent (such as tetrahydrofuran)). As a result, when spinning an acrylamide-based polymer, dry spinning, dry-wet spinning, wet spinning, or electrospinning using the aqueous solvent or the water-based mixture solvent becomes possible, and it is possible to safely produce a carbon fiber at low cost. Further, when the acrylamide-based polymer is blended with an additive described later, wet mixing using the aqueous solvent or the water-based mixture solvent becomes possible, and it is possible to safely and uniformly mix the acrylamide-based polymer and the additive described later at low cost. Note that the content of the organic solvent in the water-based mixture solvent is not particularly limited as long as the acrylamide-based polymer insoluble or poorly soluble in the aqueous solvent is in such an amount that is becomes soluble when mixed with an organic solvent. Further, among the acrylamide-based polymers, from the viewpoint that it is possible to safely produce a carbon fiber at a lower cost, an acrylamide-based polymer soluble in the aqueous solvent is preferable, and an acrylamide-based polymer soluble in water (water-soluble) is more preferable.

As a method for synthesizing such an acrylamide-based polymer, a method may be employed in which a publicly-known polymerization reaction such as radical polymerization, cationic polymerization, anionic polymerization, or living radical polymerization is performed by a polymerization method such as solution polymerization, suspension polymerization, precipitation polymerization, dispersion polymerization, or emulsion polymerization (for example, inverse emulsion polymerization). Among the above-described polymerization reactions, the radical polymerization is preferable from the viewpoint that this makes it possible to produce the acrylamide-based polymer at low costs. In addition, in a case of employing the solution polymerization, as the solvent, one in which monomers of raw materials and an obtained acrylamide-based polymer can be dissolved is preferably used. The aqueous solvent (water, alcohol, and the like, and a mixed solvent thereof) or the water-based mixture solvent (a mixed solvent of the aqueous solvent and an organic solvent (such as tetrahydrofuran)) is more preferably used, the aqueous solvent is particularly preferably used, and water is most preferably used, from the viewpoint that it allows the production safely at low costs.

In the radical polymerization, as a polymerization initiator, a conventionally publicly-known radical polymerization initiator such as azobisisobutyronitrile, benzoyl peroxide, 4,4'-azobis(4-cyanovaleric acid), ammonium persulfate, potassium persulfate, and sodium persulfate may be used. However, in a case where the aqueous solvent or the water-based mixture solvent is used as the solvent, a radical polymerization initiator that is soluble in the aqueous solvent or the water-based mixture solvent (preferably the aqueous solvent, and more preferably water) such as 4,4'-azobis(4-cyanovaleric acid), ammonium persulfate, and potassium persulfate is preferable. In addition, a conventionally publicly-known polymerization accelerator such as tetramethylethylenediamine and a molecular weight modifier such as alkyl mercaptans including n-dodecyl mercaptan are preferably used in place of or in addition to the polymerization initiator, and the polymerization initiator and the polymerization accelerator are preferably used together, and ammonium persulfate and tetramethylethylenediamine are particularly preferably used together, from the viewpoints that the spinnability of the acrylamide-based polymer is improved and the solubility of the acrylamide-based polymer in the aqueous solvent or the water-based mixture solvent is improved.

The temperature when adding the polymerization initiator is not particularly limited, but is preferably 25° C. or more, more preferably 35° C. or more, further preferably 40° C. or more, particularly preferably 45° C. or more, and most preferably 50° C. or more, from the viewpoint that the spinnability of the acrylamide-based polymer is improved. In addition, the temperature of the polymerization reaction is not particularly limited, but is preferably 50° C. or more, more preferably 60° C. or more, and most preferably 70° C. or more, from the viewpoint that the solubility of the acrylamide-based polymer in the aqueous solvent or the water-based mixture solvent is improved.

(Acrylamide-Based Polymer Fiber)

The acrylamide-based polymer fiber used in the present invention is composed of the acrylamide-based polymer, and can be used as it is for producing a carbon fiber without adding an additive such as an acid, but the acrylamide-based polymer fiber preferably contains at least one additive selected from the group consisting of acids and salts thereof, in addition to the acrylamide-based polymer, from the viewpoints that the formation of a cyclic structure by dehydration reaction and deammoniation reaction is accelerated, the formation of a continuous polycyclic structure is accelerated to improve the tensile modulus of the thermally-stabilized fiber and thus the fusion of the single fibers during the thermally-stabilizing treatment is suppressed, and the strength of the thermally-stabilized fiber is also improved, so that a larger tension can be applied during the pre-carbonizing treatment, and as a result, the obtained carbon fiber has fewer defects in the graphite structure in both of the center portion and the surface portion in the cross section of the single fiber, and the tensile strength is further improved. In addition, when the acrylamide-based polymer fiber containing the additive is subjected to thermally-stabilizing treatment while tension is applied thereto, the formation of a cyclic structure by dehydration reaction and deammoniation reaction is accelerated, and further the formation of a continuous polycyclic structure is accelerated, and as a result, a thermally-stabilized fiber having excellent load resistance at high temperature, high strength, high elastic modulus, and high carbonization yield can be obtained. This makes it possible to apply a predetermined tension to this thermally-stabilized fiber while preventing the fiber from breaking during the pre-carbonizing treatment, and as a result, the obtained carbon fiber has even fewer defects in the graphite structure in both of the center portion and the surface portion in the cross section of the single fiber, and the tensile strength is even further improved. Note that, in the thermally-stabilized fiber and the carbon fiber, at least a part of the additive and residues thereof may remain. In addition, the pre-carbonizing treatment and the carbonizing treatment may be performed by adding the additive to the thermally-stabilized fiber.

From the viewpoints that the fusion of the single fibers during thermally-stabilizing treatment is suppressed, the load resistance at high temperature, strength, elastic modulus, and carbonization yield of the thermally-stabilized fiber are improved, and the tensile strength of the carbon fiber is improved, the content of the additive is preferably 0.05 to 100 parts by mass, more preferably 0.1 to 50 parts by mass, further preferably 0.3 to 30 parts by mass, particularly preferably 0.5 to 20 parts by mass, and most preferably 1.0 to 10 parts by mass, based on 100 parts by mass of the acrylamide-based polymer.

The acids include inorganic acids such as phosphoric acid, polyphosphoric acid, boric acid, polyboric acid, sulfuric acid, nitric acid, carbonic acid, and hydrochloric acid and organic acids such as oxalic acid, citric acid, sulfonic acid, and acetic acid. In addition, the salts of such acids include metal salts (for example, sodium salts and potassium salts), ammonium salts, amine salts, and the like. Ammonium salts and amine salts are preferable, and ammonium salts are more preferable. In particular, among these additives, phosphoric acid, polyphosphoric acid, boric acid, polyboric acid, and sulfuric acid and ammonium salts of these are preferable, and phosphoric acid and polyphosphoric acid, and ammonium salts of these are particularly preferable, from the viewpoints that the load resistance at high temperature, strength, elastic modulus, and carbonization yield of the thermally-stabilized fiber are improved, and the tensile strength of the carbon fiber is improved.

In addition to the additives, the acrylamide-based polymer fiber may contain various fillers, including chlorides such as sodium chloride and zinc chloride, hydroxides such as sodium hydroxide, and nanocarbons such as carbon nanotubes and graphene, as long as the effects of the present invention are not impaired The additive is preferably soluble in at least either of the aqueous solvent and the water-based mixture solvent (more preferably the aqueous solvent, and particularly preferably water). This makes it possible to perform wet mixing using the aqueous solvent or the water-based mixture solvent when producing the acrylamide-based polymer fiber, and thus makes it possible to safely and uniformly mix the acrylamide-based polymer and the additive at low costs. In addition, this makes it possible to perform dry spinning, dry-wet spinning, wet spinning, or electrospinning using the aqueous solvent or the water-based mixture solvent, and thus makes it possible to safely produce a carbon material at low costs.

Such an acrylamide-based polymer fiber can be prepared (produced) as follows. First, the acrylamide-based polymer or the acrylamide-based polymer composition containing the acrylamide-based polymer and the additive is spun. Here, the acrylamide-based polymer or acrylamide-based polymer composition in a molten state may be used for melt spinning, spun bonding, melt blowing, or centrifugal spinning, but when the acrylamide-based polymer or the acrylamide-based polymer composition is soluble in the aqueous solvent or the water-based mixture solvent, from the viewpoint that spinnability is improved, it is preferable that the acrylamide-based polymer or the acrylamide-based polymer composition is dissolved in the aqueous solvent or the water-based mixture solvent and then the obtained aqueous solution or water-based mixed solution is used for spinning, or that the above-mentioned solution of the acrylamide-based polymer after the polymerization or the solution of the acrylamide-based polymer composition obtained by wet mixing described later is used as it is or adjusted to a desired concentration and then spun. As such a spinning method, dry spinning, wet spinning, dry-wet spinning, gel spinning, flash spinning, or electrospinning is preferable. This makes it possible to safely prepare (produce) an acrylamide-based polymer fiber having a desired fineness and average fiber diameter at low cost. In addition, the aqueous solvent is more preferably used, and water is particularly preferably used, as the solvent, from the viewpoint that an acrylamide-based polymer fiber can be more safely produced at lower costs.

In addition, the concentration of the acrylamide-based polymer in the aqueous solution or the water-based mixed solution is not particularly limited, but a high concentration of 20% by mass or more is preferable from the viewpoints that productivity and reducing costs are improved. Note that when the concentration of the acrylamide-based polymer is too high, the viscosity of the aqueous solution or the water-based mixed solution becomes high, and the spinnability is lowered, and therefore it is preferable to adjust the concentration of the aqueous solution or the water-based mixed solution to a concentration at which spinning is possible using the viscosity as an index.

As a method for producing the acrylamide-based polymer composition, it is also possible to employ a method including directly mixing the additive with the acrylamide-based polymer in a molten state (melt mixing), a method including dry-blending the acrylamide-based polymer and the additive (dry mixing), and a method including impregnating or passing the acrylamide-based polymer formed in a fiber shape into an aqueous solution or a water-based mixed solution that contains the additive or a solution in which the acrylamide-based polymer has not been completely dissolved but the additive has been dissolved. In a case where the acrylamide-based polymer and the additive used are soluble in the aqueous solvent or the water-based mixture solvent, a method including mixing the acrylamide-based polymer and the additive in the aqueous solvent or the water-based mixture solvent (wet mixing) is preferable from the viewpoint that this method can mix the acrylamide-based polymer and the additive uniformly. In addition, as the wet mixing, in a case where the above-described polymerization has been performed in the aqueous solvent or in the water-based mixture solvent in synthesizing the acrylamide-based polymer, it is also possible to employ a method including mixing the additive after the polymerization or the like. Moreover, it is also possible to collect the acrylamide-based polymer composition by removing the solvent from the obtained solution, and use the collected acrylamide-based polymer composition in the production of an acrylamide-based polymer fiber. Furthermore, it is also possible to use the obtained solution as it is in the production of the acrylamide-based polymer fiber without removing the solvent. In addition, in the wet mixing, the aqueous solvent is preferably used, and water is more preferably used, as the solvent, from the viewpoint that the acrylamide-based polymer composition can be produced more safely at lower costs. Moreover, the method for removing the solvent is not particularly limited and at least one of publicly-known methods such as distillation under reduced pressure, re-precipitation, hot-air drying, vacuum-drying, and freeze drying may be employed.

Such an acrylamide-based polymer fiber may be used as a single fiber or may be used as a fiber bundle. In a case where the acrylamide-based polymer fiber is used as a fiber bundle, the number of filaments per bundle is not particularly limited, but is preferably 50 to 96000, more preferably 100 to 48000, further preferably 500 to 36000, and particularly preferably 1000 to 24000, from the viewpoints that high productivity and mechanical properties of the thermally-stabilized fiber and the carbon fiber are improved. If the number of filaments per thread exceeds the upper limit, uneven thermally-stabilization may occur during the thermally-stabilizing treatment.

(Carbon Fiber Precursor Fiber)

The acrylamide-based polymer fiber used in the present invention may be used as a carbon fiber precursor fiber as it is during the thermally-stabilizing treatment described later. However, the acrylamide-based polymer fiber subjected to the following drawing process is preferably used as a carbon fiber precursor fiber from the viewpoints that the fiber strength is improved by the thermally-stabilizing treatment and yarn breakage due to friction or the like becomes unlikely to occur during the thermally-stabilizing treatment.

The temperature (maximum temperature) during the drawing process is not particularly limited, may be for example 150 to 330° C., but preferably 225 to 320° C., more preferably 225 to 300° C., further preferably 230 to 295° C., even further preferably 235 to 290° C., particularly preferably 240 to 285° C., and most preferably 245 to 280° C. If the maximum temperature is less than the lower limit, yarn breakage of part of the fiber may occur during the drawing process, and in the obtained carbon fiber precursor fiber (acrylamide-based polymer fiber after the drawing), the fiber strength is not sufficiently improved even by performing the thermally-stabilizing treatment, and yarn breakage due to a friction or the like becomes likely to occur during the thermally-stabilizing treatment. On the other hand, if the maximum temperature exceeds the upper limit, the fusion of the acrylamide-based polymer fibers may occur.

In addition, the draw ratio during the drawing process is preferably 1.3 to 100, more preferably 1.4 to 50, further preferably 1.5 to 40, even further preferably 1.8 to 30, particularly preferably 2.0 to 20, and most preferably 3.0 to 10. If the draw ratio is less than the lower limit, in the obtained carbon fiber precursor fiber (acrylamide-based polymer fiber after the drawing), the fiber strength is not sufficiently improved even by performing the thermally-stabilizing treatment, and yarn breakage due to a friction or the like becomes likely to occur during the thermally-stabilizing treatment. On the other hand, if the draw ratio exceeds the upper limit, yarn breakage becomes likely to occur during the drawing process.

Note that such a draw ratio can be determined by the ratio (drawing speed/introducing speed) of the feeding speed (introducing speed) of the acrylamide-based polymer fiber introduced into the heating furnace or the like to the feeding speed (drawing speed) of the carbon fiber precursor fiber drawn from the heating furnace or the like, or can also be determined by the ratio between the lengths of the acrylamide-based polymer fiber and the carbon fiber precursor fiber (the length of the carbon fiber precursor fiber/the length of the acrylamide-based polymer fiber). Such a draw ratio can be controlled by adjusting the ratio (drawing speed/introducing speed) between the feeding speeds of the acrylamide-based polymer fiber and the carbon fiber precursor fiber as well as the tension applied to the fiber, the temperature during the drawing process, the water content of the acrylamide-based polymer fiber, and the like. However, even when, for example, the temperature during the drawing process and the water content of the acrylamide-based polymer fiber are the same, the draw ratio changes depending on the composition of the acrylamide-based polymer, the presence or absence of the additive in the acrylamide-based polymer fiber, and the amount thereof added, and thus it is necessary to adjust to the desired draw ratio by adjusting the ratio (drawing speed/introducing speed) between the feeding speeds of the acrylamide-based polymer fiber and the carbon fiber precursor fiber as well as the tension applied to the fiber (controlled by a weight, a spring, and the like).

The method of drawing treatment is not particularly limited, but it is possible to employ a publicly-known drawing means such as a method including drawing in a gas phase heated to a predetermined temperature (for example, in a heating furnace (including a hot air furnace) containing air or an inert gas heated to a predetermined temperature) (air drawing process), a method including using a heated body such as a hot roller heated to a predetermined temperature (heat drawing process), and a method including drawing in a solvent heated to a predetermined temperature (wet drawing process). Among these drawing process methods, air drawing process and heat drawing process are preferable. In the case of the air drawing process, the drawing process may be performed in either an oxidizing gas atmosphere or an inert gas atmosphere, but from the viewpoint of convenience, it is preferably performed in an oxidizing gas atmosphere, particularly in air. Further, in the present invention, since the thermally-stabilizing treatment described later is performed after performing the drawing process, the drawing process and the thermally-stabilizing treatment may be continuously or simultaneously performed using a heating furnace for use in thermally-stabilizing treatment (thermally-stabilizing furnace). Further, the drawing process may be performed in one stage or in two or more stages.

In such a carbon fiber precursor fiber (that is, undrawn acrylamide-based polymer fiber or the acrylamide-based polymer fiber after the drawing process), the fineness of the single fiber is preferably 0.1 to 7 dtex, more preferably 0.15 to 6 dtex, further preferably 0.2 to 5 dtex, and particularly preferably 0.25 to 4 dtex. If the fineness of the single fiber of the carbon fiber precursor fiber is less than the lower limit, yarn breakage is likely to occur, and stable winding and thermally-stabilizing treatment tend to become difficult. On the other hand, if the fineness of the single fiber of the carbon fiber precursor fiber exceeds the upper limit, it becomes difficult to sufficiently thermally-stabilize the single fiber up to the center portion of the cross section, and the effect of improving the tensile strength by drawing during the drawing process tends to be reduced.

Further, in the carbon fiber precursor fiber, the average fiber diameter of the single fiber is not particularly limited, but is preferably 3 to 80 μm, more preferably 3 to 50 μm, further preferably 4 to 40 μm, particularly preferably 4 to 30 μm, and most preferably 5 to 25 μm. If the average fiber diameter of the single fiber of the carbon fiber precursor fiber is less than the lower limit, yarn breakage is likely to occur, and stable winding and thermally-stabilizing treatment tend to become difficult. On the other hand, if the average fiber diameter of the single fiber of the carbon fiber precursor fiber exceeds the upper limit, in the single fiber of the obtained thermally-stabilized fiber, the structure is significantly different between the center portion and the surface portion in the cross section, the tensile strength of the obtained carbon fiber tends to decrease.

In addition, a conventionally known oil agent such as a silicone-based oil agent may be adhered to the carbon fiber precursor fiber from the viewpoints of fiber focusing, improved handling, and prevention of adhesion between fibers. The timing for adhering the oil agent may be any of that before the drawing process (that is, after adhering the oil agent to the acrylamide-based polymer, the drawing process is performed), that during the drawing process (that is, while performing the drawing process, the oil agent is adhered to the acrylamide-based polymer), and that after the drawing process (that is, after subjecting the acrylamide-based polymer to drawing process, the oil agent is adhered to the obtained carbon fiber precursor fiber). The oil agent is not particularly limited, but is preferably a silicone-based oil agent, and particularly preferably a modified silicone-based oil agent (for example, amino-modified silicone-based oil agents, epoxy-modified silicone-based oil agents, ether-modified silicone-based oil agents, and aryl-modified silicone-based oil agents such as methylphenyl silicone). These oil agents may be used alone or in combination of two or more kinds. In addition, the oil agent concentration in the oil agent bath used for adhering an oil agent is preferably 0.1 to 20% by mass, and more preferably 1 to 10% by mass. Further, the carbon fiber precursor fiber to which the oil agent is adhered in this manner is dried at a temperature of preferably 50 to 250° C. (preferably 100 to 200° C.). As a result, a dense carbon fiber precursor fiber is obtained. The drying method is not particularly limited, and examples thereof include a drying method using a heat roller whose surface temperature is heated to a temperature within the above range and a method using a heating furnace.

(Thermally-Stabilized Fiber)

The thermally-stabilized fiber used in the present invention is obtained by subjecting the carbon fiber precursor fiber to heating treatment (thermally-stabilizing treatment) in an oxidizing atmosphere (for example, in air), and is a thermally-stabilized fiber of the acrylamide-based polymer fiber. The carbon fiber precursor fiber contains the acrylamide-based polymer, is not easily thermally decomposed by the thermally-stabilizing treatment, and exhibits a high carbonization yield because the structure of the acrylamide-based polymer is converted into a structure having high heat resistance by the thermally-stabilizing treatment. In particular, in the carbon fiber precursor fiber containing the additive, the catalytic action of an acid or a salt thereof as the additive promotes the dehydration reaction and deammoniation reaction of the acrylamide-based polymer, and thus a cyclic structure (imide ring structure) is easily formed in the molecule, and the structure of the acrylamide-based polymer is easily converted into a structure having high heat resistance, so that the carbonization yield is further increased.

The thermally-stabilizing treatment is preferably performed at a temperature in the range of 200 to 500° C., more preferably performed at a temperature in the range of 270 to 450° C., further preferably performed at a temperature in the range of 300 to 430° C., and particularly preferably performed at a temperature in the range of 305 to 420° C., but is not particularly limited. Note that the thermally-stabilizing treatment performed at such a temperature includes not only thermally-stabilizing treatment at the maximum temperature during the thermally-stabilizing treatment described later (thermally-stabilizing treatment temperature) but also thermally-stabilizing treatment in the process of raising the temperature to the thermally-stabilizing treatment temperature, and the like.

In addition, the maximum temperature during the thermally-stabilizing treatment (thermally-stabilizing treatment temperature) is preferably higher than the temperature during the drawing process (maximum temperature) and at 500° C. or less, more preferably 310 to 450° C., further preferably 320 to 440° C., particularly preferably 325 to 430° C., and most preferably 330 to 420° C. If the thermally-stabilizing treatment temperature is less than the lower limit, the dehydration reaction and deammoniation reaction of the acrylamide-based polymer are not promoted, and it is difficult to form a cyclic structure (imide ring structure) in the molecule, and thus the heat resistance of the thermally-stabilized fiber produced tends to be low, and the carbonization yield tends to decrease. On the other hand, if the thermally-stabilizing treatment temperature exceeds the upper limit, the thermally-stabilized fiber produced tends to be thermally decomposed.

The thermally-stabilizing treatment time (heating time at the maximum temperature) is not particularly limited, and heating for a long time (for example, more than 2 hours) is possible, but the time is preferably 1 to 120 minutes, more preferably 2 to 60 minutes, further preferably 3 to 50 minutes, and particularly preferably 4 to 40 minutes. The carbonization yield can be improved by setting the heating time during the thermally-stabilizing treatment to be equal to or greater than the lower limit, while the cost can be reduced by setting it to 2 hours or less.

Further, in producing the thermally-stabilized fiber, it is preferable to perform the thermally-stabilizing treatment while or after applying tension to the carbon material precursor fiber. This further improves the fusion prevention property of the carbon material precursor fiber during the thermally-stabilizing treatment, and it is possible to obtain a thermally-stabilized fiber having excellent load resistance at high temperature, high strength, high elastic modulus, and high carbonization yield. The tension applied to the carbon material precursor fiber is not particularly limited, but is preferably 0.007 to 30 mN/dtex, more preferably 0.010 to 20 mN/dtex, further preferably 0.020 to 5 mN/dtex, still further preferably 0.025 to 1.5 mN/dtex, particularly preferably 0.030 to 1 mN/dtex, and most preferably 0.035 to 0.5 mN/dtex. If the tension applied to the carbon material precursor fiber is less than the lower limit, the fusion of the carbon material precursor fiber during the thermally-stabilizing treatment is not sufficiently suppressed, and the load resistance at high temperature, strength, elastic modulus, and carbonization yield of the thermally-stabilized fiber tend to decrease. On the other hand, if the tension applied to the carbon material precursor fiber exceeds the upper limit, yarn breakage may occur during the thermally-stabilizing treatment. Note that in the present invention, the tension (unit: mN/dtex) applied to the carbon material precursor fiber is a value obtained by dividing the tension (unit: mN) applied to the carbon material precursor fiber by the fineness (unit: dtex) of the carbon material precursor fiber in an absolute dry state, that is, the tension per unit fineness of the carbon material precursor fiber. In addition, the tension applied to the carbon material precursor fiber can be adjusted by using a difference in rotational speed between an inlet-side roller and an outlet-side roller, or using a load cell, a spring, a weight, or the like, on the inlet side, the outlet side, or the like of a heating device such as a thermally-stabilizing furnace.

Further, when the carbon material precursor fiber is subjected to thermally-stabilizing treatment while a predetermined tension is applied, a tension may or may not have been applied in the process of raising the temperature to the thermally-stabilizing treatment temperature as long as a predetermined tension is applied to the carbon material precursor fiber at the thermally-stabilizing treatment temperature (maximum temperature during the thermally-stabilizing treatment), but it is preferable that tension is applied even in the temperature raising process or the like from the viewpoint that the effect of applying tension can be sufficiently obtained. In addition, the tension may be applied from an initial stage such as the temperature raising process, or may be applied from an intermediate stage.

In addition, in producing a thermally-stabilized fiber, after heating treatment is performed while a predetermined tension is applied at the thermally-stabilizing treatment temperature (maximum temperature during the thermally-stabilizing treatment), the heating treatment may be performed at a temperature higher than the thermally-stabilizing treatment temperature with or without applying a tension other than the predetermined tension.

Moreover, in producing a thermally-stabilized fiber, thermally-stabilizing treatment may be performed while performing drawing process. The draw ratio during the thermally-stabilizing treatment is preferably 1.3 to 100, more preferably 1.7 to 50, further preferably 2.0 to 25, and particularly preferably 3.0 to 10. If the draw ratio during the thermally-stabilizing treatment is less than the lower limit, the fusion of the carbon material precursor fiber during the thermally-stabilizing treatment is not sufficiently suppressed, and the load resistance at high temperature, strength, elastic modulus, and carbonization yield of the thermally-stabilized fiber tend to decrease. On the other hand, if the draw ratio during the thermally-stabilizing treatment exceeds the upper limit, yarn breakage may occur during the thermally-stabilizing treatment.

Note that such a draw ratio can be determined by the ratio (drawing speed/introducing speed) of the feeding speed (introducing speed) of the carbon material precursor fiber introduced into the heating furnace (thermally-stabilizing furnace) to the feeding speed (drawing speed) of the thermally-stabilized fiber drawn from the heating furnace or the like, or can also be determined by the ratio between the lengths of the carbon material precursor fiber and the thermally-stabilized fiber (the length of the thermally-stabilized fiber/the length of the carbon material precursor fiber). Such a draw ratio can be controlled by adjusting the ratio (drawing speed/introducing speed) between the feeding speeds of the carbon material precursor fiber and the thermally-stabilized fiber as well as the tension applied to the fiber, the temperature during the drawing process, the water content of the acrylamide-based polymer fiber, and the like. However, even when, for example, the temperature during the drawing process and the water content of the acrylamide-based polymer fiber are the same, the draw ratio changes depending on the composition of the acrylamide-based polymer, the presence or absence of the additive in the acrylamide-based polymer fiber, and the amount added thereof, and thus it is necessary to adjust to the desired draw ratio by adjusting the ratio (drawing speed/introducing speed) between the feeding speeds of the carbon material precursor fiber and the thermally-stabilized fiber as well as the tension applied to the fiber (controlled by a weight, a spring, and the like).

In such a thermally-stabilized fiber, the fineness of the single fiber is preferably 0.1 to 6 dtex, more preferably 0.15 to 6 dtex, further preferably 0.2 to 5 dtex, and particularly preferably 0.25 to 4 dtex. If the fineness of the single fiber of the thermally-stabilized fiber is less than the lower limit, yarn breakage is likely to occur and the stable winding and the carbonizing treatment tend to be difficult. On the other hand, if the fineness of the single fiber of the thermally-stabilized fiber exceeds the upper limit, the tensile strength of the carbon fiber obtained tends to decrease.

In the thermally-stabilized fiber, the average fiber diameter of the single fiber is not particularly limited, but is preferably 3 to 50 μm, more preferably 3 to 40 μm, further preferably 4 to 30 μm, particularly preferably 4 to 25 μm, and most preferably 5 to 20 μm. If the average fiber diameter of the single fiber of the thermally-stabilized fiber is less than the lower limit, yarn breakage is likely to occur, and the stable winding and the carbonizing treatment tend to be difficult. On the other hand, if the average fiber diameter of the single fiber of the thermally-stabilized fiber exceeds the upper limit, in the single fiber of the obtained carbon fiber, the structure is significantly different between the center portion and the surface portion in the cross section, and the tensile strength tends to decrease.

Further, the thermally-stabilized fiber preferably has an absorption peak derived from a polycyclic structure within the range of 1560 to 1595 $cm^{-1}$ in the infrared absorption spectrum. The thermally-stabilized fiber having such an absorption peak has high heat resistance and a high carbonization yield. Further, in the thermally-stabilized fiber, the ratio ($I_A$/IS) of the intensity ($I_A$) of the absorption peak observed in the range of 1560 to 1595 $cm^{-1}$ to the intensity ($I_B$) of the absorption peak derived from the amide group of the acrylamide-based polymer observed near 1648 $cm^{-1}$ is preferably 0.1 to 20, and preferably 0.5 to 10. A thermally-stabilized fiber bundle having $I_A/I_B$ within the above range has high heat resistance and carbonization yield.

<Method for Producing Carbon Fiber>

The method for producing a carbon fiber of the present invention is a method comprising: a pre-carbonizing treatment step of obtaining a pre-carbonized fiber by subjecting a thermally-stabilized fiber of an acrylamide-based polymer fiber to heating treatment at a predetermined temperature while applying a predetermined tension thereto under an inert gas atmosphere; and a carbonizing treatment step of obtaining a carbon fiber by subjecting the pre-carbonized fiber to heating treatment.

(Pre-Carbonizing Treatment Step)

In the pre-carbonizing treatment step, a pre-carbonized fiber is obtained by subjecting the thermally-stabilized fiber to heating treatment at a predetermined temperature while applying a predetermined tension thereto under an inert gas atmosphere (in an inert gas such as nitrogen, argon, helium, or xenon).

In the present invention, the tension applied to the thermally-stabilized fiber needs to be in the range of 0.05 to 4 mN/dtex. When the tension applied to the thermally-stabilized fiber is within the above range, breakage of the fiber is unlikely to occur during the pre-carbonizing treatment, and the obtained carbon fiber has fewer defects in the graphite structure in both of the center portion and the surface portion in the cross section of the single fiber, and the tensile strength is improved. On the one hand, if the tension applied to the thermally-stabilized fiber is less than the lower limit, the obtained carbon fiber has more defects in the graphite structure in both of the center portion and the surface portion in the cross section of the single fiber, so that voids are likely to be formed and the tensile strength decreases. On the other hand, if the tension applied to the thermally-stabilized fiber exceeds the upper limit, breakage of the fiber is likely to occur during the pre-carbonizing treatment, and fluffing is likely to occur on the obtained carbon fiber. Moreover, since the obtained carbon fiber has more defects in the graphite structure in at least one of the center portion or the surface portion in the cross section of the single fiber, voids are likely to be formed and the tensile strength decreases. In addition, the tension applied to the thermally-stabilized fiber is preferably 0.1 to 3 mN/dtex, more preferably 0.12 to 2.5 mN/dtex, further preferably 0.15 to 1.5 mN/dtex, particularly preferably 0.2 to 1.3 mN/dtex, and most preferably 0.25 to 0.9 mN/dtex from the viewpoints that the breakage of the fiber is unlikely to occur during the pre-carbonizing treatment, the obtained carbon fiber has fewer defects in the graphite structure in both of the center portion and the surface portion in the cross section of the single fiber, and the tensile strength is further improved. Note that in the present invention, the tension (unit: mN/dtex) applied to the thermally-stabilized fiber is a value obtained by dividing the tension (unit: mN) applied to the thermally-stabilized fiber by the fineness (unit: dtex) of the thermally-stabilized fiber in an absolute dry state, that is, the tension per unit fineness of the thermally-stabilized fiber. In addition, the tension applied to the thermally-stabilized fiber can be adjusted by using a difference in rotational speed between an inlet-side roller and an outlet-side roller, or using a load cell, a spring, a weight, or the like on the inlet side, the outlet side, or the like of a heating device such as a thermally-stabilizing furnace.

In addition, in the present invention, the heating treatment temperature for the thermally-stabilized fiber needs to be in the range of 300 to 1000° C. When the heating treatment temperature is within the above range, a carbon fiber having excellent tensile strength can be obtained. On the one hand, if the heating treatment temperature is less than the lower limit, in the obtained carbon fiber, the effect of improving the tensile modulus and the tensile strength tends to decrease. On the other hand, if the heating treatment temperature exceeds the upper limit, in the obtained carbon fiber, the effect of improving the tensile strength tends to decrease. In addition, the heating treatment temperature is preferably 300 to 950° C., more preferably 350 to 900° C., further preferably 400 to 850° C., and particularly preferably 450 to 800° C. from the viewpoint that the tensile strength is improved in the obtained carbon fiber.

Moreover, in the pre-carbonizing treatment step, the thermally-stabilized fiber may be subjected to the heating treatment while the drawing process is performed. The draw ratio in this case is preferably high from the viewpoint that the orientation of the obtained pre-carbonized fiber increases, but needs to be set in consideration of yarn breakage during the pre-carbonizing treatment and fluffing on the obtained carbon fiber.

(Carbonizing Treatment Step)

In the method for producing a carbon fiber of the present invention, carbonization of the pre-carbonized fiber is caused to further proceed and a carbon fiber having excellent tensile strength can be obtained by subjecting the pre-carbonized fiber obtained in the pre-carbonizing treatment step to heating treatment at a temperature higher than the temperature during the pre-carbonizing treatment under an inert gas atmosphere (in an inert gas such as nitrogen, argon, helium, or xenon).

The heating temperature (maximum temperature) in the carbonizing treatment step is preferably 1000° C. or more, more preferably 1100° C. or more, further preferably 1200° C. or more, and particularly preferably 1300° C. or more. In addition, the upper limit of the heating temperature is preferably 3000° C. or less, more preferably 2500° C. or less, further preferably 2000° C. or less, and particularly preferably 1900° C. or less.

In addition, in the method for producing a carbon fiber of the present invention, carbonizing treatment (also referred to as "graphitizing treatment") may be performed at a heating temperature (maximum temperature) of 2000° C. or more and 3000° C. or less under an inert gas atmosphere after the pre-carbonized fiber is subjected to carbonizing treatment at a heating temperature (maximum temperature) of 1000° C. or more (more preferably 1100° C. or more, further preferably 1200° C. or more, and particularly preferably 1300° C. or more) and less than 2000° C. under an inert gas atmosphere.

The heating time in the carbonizing treatment is not particularly limited, but is preferably 10 seconds to 60 minutes, more preferably 30 seconds to 30 minutes, and further preferably 1 to 10 minutes.

In addition, in the method for producing a carbon fiber of the present invention, it is preferable to subject the carbon fiber to a surface treatment such as an electrolytic treatment or a plasma treatment in order to modify the surface of the carbon fiber and optimize the adhesion to the resin. As a result, the problems of the carbon fiber are solved, such as when a composite material with a resin is formed, the strength characteristics in the fiber axis direction are lowered, and the strength characteristics in the direction perpendicular to the fiber axis direction are not exhibited, and a composite material is obtained in which the strength characteristics are balanced in the fiber axis direction and the direction perpendicular thereto.

Examples of the electrolytic solution used in the electrolytic treatment include an aqueous solution containing an acid, an alkali, or a salt thereof. Examples of the acid include sulfuric acid, nitric acid, and hydrochloric acid, and examples of the alkali include sodium hydroxide, potassium hydroxide, tetraethylammonium hydroxide, ammonium carbonate, and ammonium hydrogencarbonate.

Further, the carbon fiber subjected to the electrolytic treatment may be washed with water to remove the electrolytic solution, subjected to drying treatment, and then given a sizing agent in order to improve the adhesion with a resin. As such a sizing agent, a compound having multiple reactive functional groups is preferable. The reactive functional groups are not particularly limited, but are preferably functional groups capable of reacting with a carboxy group or a hydroxyl group, and more preferably epoxy groups. In the sizing agent, the number of the reactive functional groups present in one molecule of the compound is preferably 2 to 6, more preferably 2 to 4, and particularly preferably 2. If the number of the reactive functional groups is one, the adhesion between the carbon fiber and the resin tends not to be improved. On the other hand, if the number of the reactive functional groups exceeds the upper limit, the intermolecular crosslink density of the compound constituting the sizing agent increases, the layer formed by the sizing agent becomes brittle, and the tensile strength of the composite material of the carbon fiber and the resin tends to decrease.

In the present invention, the pre-carbonizing treatment is performed by subjecting the thermally-stabilized fiber of the acrylamide-based polymer fiber to heating treatment at a predetermined temperature while applying a predetermined tension thereto under an inert gas atmosphere, and the carbonizing treatment is performed by further performing heating treatment. In this way, the carbon fiber of the present invention can be obtained in which an average fiber diameter of a single fiber is in a predetermined range, an average value of an intensity ratio of the D peak to the G peak in a Raman spectrum in a cross section of the single fiber is in a predetermined range in both of a center portion and a surface portion in the cross section of the single fiber.

[Carbon Fiber]

Next, the carbon fiber of the present invention is described. The carbon fiber of the present invention is a carbon fiber wherein an average fiber diameter of a single fiber is in a range of 3 to 10 μm, and an average value of an intensity ratio (D/G) of the D peak to the G peak in a Raman spectrum in a cross section perpendicular to a fiber axis direction of the single fiber is 0.90 or less in a region (center portion) inside a circle having a diameter of 1 μm and centered at a center of gravity of the cross section of the single fiber, and is 0.90 or less in a region (surface portion) up to 1 μm inside from an outer periphery of the cross section of the single fiber, wherein the D peak is observed at around 1360 $cm^{1}$ and derived from a defect in a graphite structure and the G peak is observed at around 1590 $cm^{-1}$ and derived from the graphite structure. Such a carbon fiber can be obtained by the method for producing a carbon fiber of the present invention.

In the carbon fiber of the present invention, the average fiber diameter of the single fiber needs to be in the range of 3 to 10 μm. If the average fiber diameter of the single fiber of the carbon fiber is less than the lower limit, in a case where a composite material is prepared using a resin or the like as a matrix, a high viscosity of the matrix may cause insufficient impregnation of the resin or the like into the carbon fiber, which may reduce the tensile strength of the composite material. On the other hand, if the average fiber diameter of the single fiber of the carbon fiber exceeds the upper limit, the tensile strength of the carbon fiber tends to decrease. Moreover, the average fiber diameter of the single fiber of the carbon fiber is preferably 4 to 9 μm and more preferably 5 to 8 μm from the viewpoint that in a case where a composite material is prepared using a resin or the like as a matrix, the tensile strength of the composite material is improved and the tensile strength of the carbon fiber is improved.

In addition, in the carbon fiber of the present invention, the average value of the intensity ratio (D/G) of the D peak to the G peak in the Raman spectrum in the cross section of the single fiber needs to be 0.90 or less in the center portion and 0.90 or less in the surface portion in the cross section of the single fiber. Here, the average value of the D/G is an index indicating the magnitude of the ratio of the defect structure to the graphite structure in the single fiber. A smaller average value of the D/G means that defects in the graphite structure are fewer. Hence, a carbon fiber in which the average value of the D/G is in the above range in both of the center portion and the surface portion in the cross section of the single fiber has fewer defects in the graphite structure in both of the center portion and the surface portion in the cross section of the single fiber, and accordingly has excellent tensile strength. On the other hand, a carbon fiber in which the average value of the D/G exceeds the upper limit in at least one of the center portion or the surface portion in the cross section of the single fiber has more defects in the graphite structure in at least one of the center portion or the surface portion in the cross section of the single fiber, and accordingly has a low tensile strength. In addition, the average value of the D/G in the center portion and/or the surface portion in the cross section of the single fiber is preferably 0.85 or less from the viewpoint that the obtained carbon fiber has fewer defects in the graphite structure and the tensile strength is improved.

Note that in the present invention, the average value of the intensity ratio (D/G) of the D peak to the G peak in the Raman spectrum in the cross section of the single fiber can be obtained as described below. Specifically, first, the carbon fiber is observed using a microscopic Raman spectrophotometer (for example, "inVia Reflex/StreamLine" manufactured by Renishaw plc., a microscope: manufactured by Leica Camera AG, an object lens: 100-power, a detector: CCD (the number of channels: 1024×256)), and Raman spectroscopic analysis is performed on the cross sections perpendicular to the fiber axis directions of randomly extracted single fibers under conditions of a laser wavelength of 532 nm, a diffraction grating of 1800 lines/mm, and a resolution of 0.6 μm to obtain Raman mapping images.

Next, based on the Raman mapping image of the cross section of the single fiber, an average value of a ratio (D/G) of the intensity of the D peak to the intensity of the G peak in the Raman spectrum in each of a region (center portion) inside a circle having a diameter of 1 μm and centered at a center of gravity of the cross section of the single fiber and a region (surface portion) up to 1 μm inside from an outer periphery of the cross section of the single fiber was determined, wherein the D peak is observed at around 1360 $cm^{-1}$ and derived from defects in a graphite structure and the G peak is observed at around 1590 $cm^{-1}$ and derived from the graphite structure. As the peak intensity, an intensity determined by fitting in a mixed mode of Gaussian fitting and Lorentzian fitting can be employed.

EXAMPLES

Hereinafter, the present invention is described in more detail based on Examples and Comparative Examples, but the present invention is not limited to the following Examples. Note that each acrylamide-based polymer and each acrylamide-based polymer fiber used in Examples and Comparative Examples were prepared by the following methods.

Preparation Example 1

<Synthesis of Acrylamide/Acrylonitrile Copolymer>

To 400 parts by mass of deionized water, 100 parts by mass of a monomer composed of 75 mol % of acrylamide (AM) and 25 mol % of acrylonitrile (AN) and 4.36 parts by mass of tetramethylethylenediamine were dissolved, and to the obtained aqueous solution, 3.43 parts by mass of ammonium persulfate was added while stirring under a nitrogen atmosphere, and then the mixture was heated at 70° C. for 150 minutes, and subsequently the temperature was raised to 90° C. during a period of 30 minutes, and after that the mixture was heated at 90° C. for 1 hour to perform a polymerization reaction. The obtained aqueous solution was added dropwise to methanol to precipitate a copolymer, which was collected and vacuum dried at 80° C. for 12 hours to obtain a water-soluble acrylamide/acrylonitrile copolymer (AM/AN copolymer).

<Measurement of Composition Ratio of AM/AN Copolymer>

The obtained AM/AN copolymer was dissolved in heavy water, and the obtained aqueous solution was subjected to $^{1}$C-NMR measurement under the conditions of room temperature and a frequency of 100 MHz. In the obtained $^{13}$C-NMR spectrum, based on the integrated intensity ratio between the carbon-derived peak of the carbonyl group of the acrylamide appearing at about 177 ppm to about 182 ppm and the carbon-derived peak of the cyano group of the acrylonitrile appearing at about 121 ppm to about 122 ppm, the molar ratio (AM/AN) of the acrylamide (AM) unit and the acrylonitrile (AN) unit in the AM/AN copolymer was determined, and it was found that AM/AN=75 mol %/25 mol %.

Preparation Example 2

<Synthesis of Acrylamide/Acrylonitrile/Acrylic Acid Copolymer>

To 566.7 parts by mass of deionized water, 100 parts by mass of a monomer composed of 73 mol % of acrylamide (AM), 25 mol % of acrylonitrile (AN), and 2 mol % of acrylic acid (AA) and 4.36 parts by mass of tetramethylethylenediamine were dissolved, and to the obtained aqueous solution, 3.43 parts by mass of ammonium persulfate was added while stirring under a nitrogen atmosphere, and then the mixture was heated at 70° C. for 150 minutes, and subsequently the temperature was raised to 90° C. during a period of 30 minutes, and after that the mixture was heated at 90° C. for 1 hour to perform a polymerization reaction. The obtained aqueous solution was added dropwise to methanol to precipitate a copolymer, which was collected and vacuum dried at 80° C. for 12 hours to obtain a water-soluble acrylamide/acrylonitrile/acrylic acid copolymer (AM/AN/AA copolymer).

<Measurement of Composition Ratio of AM/AN/AA Copolymer>

The obtained AM/AN/AA copolymer was dissolved in heavy water, and the obtained aqueous solution was subjected to $^{13}$C-NMR measurement under the conditions of room temperature and a frequency of 100 MHz. In the obtained 13C-NMR spectrum, based on the integrated intensity ratio among the carbon-derived peak of the carbonyl group of the acrylamide appearing at about 177 ppm to about 182 ppm, the carbon-derived peak of the cyano group of the acrylonitrile appearing at about 121 ppm to about 122 ppm, and the carbon-derived peak of the carbonyl group of the acrylic acid appearing at about 179 ppm to about 182 ppm, the molar ratio ((AM+AA)/AN) of acrylamide (AM) units and acrylic acid (AA) units to acrylonitrile (AN) units in the AM/AN/AA copolymer was calculated.

In addition, the AM/AN/AA copolymer was subjected to infrared spectroscopic analysis (IR), and in the obtained IR spectrum, based on the intensity ratio between the peak derived from the acrylamide (AM) appearing at about 1678 $cm^{-1}$, the peak derived from the acrylonitrile (AN) appearing at about 2239 $cm^{-1}$, and the peak derived from acrylic acid (AA) appearing at about 1715 $cm^{-1}$, the molar ratio (AM/AA) of the acrylamide (AM) units and the acrylic acid (AA) units in the AM/AN/AA copolymer was calculated.

The above-described (AM+AA)/AN and the AM/AA were used to determine the molar ratio (AM/AN/AA) among the acrylamide (AM) units, the acrylonitrile (AN) units, and the acrylic acid (AA) units in the AM/AN/AA copolymer, and it was found that AM/AN/AA=73 mol %/25 mol %/2 mol %.

Preparation Example 3

<Synthesis of Acrylamide/Acrylonitrile/Acrylic Acid Copolymer and Measurement of Composition Ratio>

A water-soluble acrylamide/acrylonitrile/acrylic acid copolymer (AM/AN/AA copolymer) was obtained in the same manner as in Preparation Example 2 except for using 100 parts by mass of a monomer composed of 65 mol % of acrylamide (AM), 33 mol % of acrylonitrile (AN), and 2 mol % of acrylic acid (AA) as the monomer. When the composition ratio of this AM/AN/AA copolymer was measured in the same manner as in Preparation Example 2, it was found that AM/AN/AA=65 mol %/33 mol %/2 mol %.

Production Example 1

<Production of Acrylamide-Based Polymer Fiber>

The AM/AN copolymer (AM/AN=75 mol %/25 mol %) obtained in Preparation Example 1 was dissolved in deionized water, and the obtained aqueous solution was used to perform dry spinning so that the fineness of the acrylamide-based polymer fiber was about 3 dtex/fiber and the average fiber diameter was about 17 μm, thereby preparing an acrylamide-based polymer fiber (f-1). When the fineness and the average fiber diameter of this acrylamide-based polymer fiber (f-1) were measured by the following methods, the fineness was 3.3 dtex/fiber, and the average fiber diameter was 18 μm.

<Fineness of Acrylamide-Based Polymer Fiber>

One hundred acrylamide-based polymer fibers obtained were bundled to produce an acrylamide-based polymer fiber bundle (100 fibers/bundle), and the mass of this fiber bundle at the time of absolute drying or after drying at 120° C. for 2 hours was measured, and the fineness of the fiber bundle was calculated by the following formula:

Fineness of Fiber Bundle [dtex]=Mass of Fiber Bundle [g]/Fiber Length [m]×10000 [m]

and the fineness of the single fibers constituting the fiber bundle (the fineness of the acrylamide-based polymer fiber) was determined.

<Average Fiber Diameter of Acrylamide-Based Polymer Fiber>

The density of the acrylamide-based polymer fiber bundle was measured using a dry automatic densitometer ("AccuPyc II 1340" manufactured by Micromeritics Instrument Corporation), and the average fiber diameter of the single fibers constituting the fiber bundle (the average fiber diameter of the acrylamide-based polymer fiber) was determined by the following formula:

$$D=\{(Dt\times 4\times 100)/(\rho\times\pi\times n)\}^{1/2}$$

[in the formula, D represents the average fiber diameter [μm] of the single fibers constituting the fiber bundle, Dt represents the fineness [dtex] of the fiber bundle, ρ represents the density [g/cm$^3$] of the fiber bundle, and n represents the number [fibers] of the single fibers constituting the fiber bundle].

<Production of Thermally-Stabilized Fiber>

One thousand five hundred acrylamide-based polymer fibers obtained (f-1) were bundled to produce a fiber bundle (1500 fibers/bundle). This fiber bundle was drawn at a draw ratio of 2 under an air atmosphere at a temperature of 250° C. to produce a carbon fiber precursor fiber bundle (f-1) (1500 fibers/bundle). The obtained carbon fiber precursor fiber bundle (1500 fibers/bundle) was combined to produce a precursor fiber bundle of 12000 fibers/bundle, and this precursor fiber bundle (12000 fibers/bundle) was subjected to heating treatment (the thermally-stabilizing treatment) for 60 minutes at 350° C. (the thermally-stabilizing treatment temperature (the maximum temperature during the thermally-stabilizing treatment)) under an air atmosphere to produce a thermally-stabilized fiber bundle (f-1) (12000 fibers/bundle). When the single fiber fineness and the average fiber diameter of this thermally-stabilized fiber bundle (f-1) were measured by the following methods, the fineness was 1.4 dtex/fiber and the average fiber diameter was 11 μm.

<Fineness of Thermally-Stabilized Fiber>

The mass of the obtained thermally-stabilized fiber bundle at the time of absolute drying or after drying at 120° C. for 2 hours was measured, and the fineness of the fiber bundle was calculated by the following formula:

Fineness of Fiber Bundle [dtex]=Mass of Fiber Bundle [g]/Fiber Length [m]×10000 [m]

and the fineness of the single fiber constituting the thermally-stabilized fiber bundle (the fineness of the thermally-stabilized fiber) was determined.

<Average Fiber Diameter of Thermally-Stabilized Fiber>

Regarding the obtained thermally-stabilized fiber bundle, the side surface was observed using a microscope ("Digital Microscope VHX-1000" manufactured by KEYENCE CORPORATION), and a measurement point of the fiber diameter of each of 10 randomly extracted single fibers was randomly selected to measure the fiber diameters of the thermally-stabilized single fibers constituting the thermally-stabilized fiber bundle, and the average value (the average fiber diameter of the thermally-stabilized fiber) was determined.

Production Example 2

<Production of Acrylamide-Based Polymer Fiber>

The AM/AN copolymer (AM/AN=75 mol %/25 mol %) obtained in Preparation Example 1 was dissolved in deionized water, and to the obtained aqueous solution, 3 parts by mass of phosphoric acid relative to 100 parts by mass of the AM/AN copolymer was added to completely dissolve it. The obtained aqueous solution was used to perform dry spinning so that the fineness of the acrylamide-based polymer fiber was about 3 dtex/fiber and the average fiber diameter was about 17 μm, thereby preparing an acrylamide-based polymer fiber (f-2). When the fineness and the average fiber diameter of this acrylamide-based polymer fiber (f-2) were measured in the same manner as in Production Example 1, the fineness was 3.8 dtex/fiber, and the average fiber diameter was 20 μm.

<Production of Thermally-Stabilized Fiber>

A carbon fiber precursor fiber bundle (f-2) (1500 fibers/bundle) and a thermally-stabilized fiber bundle (f-2) (12000 fibers/bundle) were produced in the same manner as in Production Example 1 except that the acrylamide-based polymer fiber (f-2) was used instead of the acrylamide-based polymer fiber (f-1), the temperature during drawing was changed to 260° C. and the draw ratio was changed to 4. When the single fiber fineness and the average fiber diameter of this thermally-stabilized fiber bundle (f-2) were measured in the same manner as in Production Example 1, the fineness was 0.9 dtex/fiber and the average fiber diameter was 9 μm.

Production Example 3

<Production of Acrylamide-Based Polymer Fiber>

An acrylamide-based polymer fiber (f-3) was produced in the same manner as in Production Example 2 except that the AM/AN/AA copolymer (AM/AN/AA-73 mol %/25 mol %/2 mol %) obtained in Preparation Example 2 was used instead of the AM/AN copolymer (AM/AN=75 mol %/25 mol %) obtained in Preparation Example 1, and dry spinning was performed so that the fineness of the acrylamide-based polymer fiber was about 6 dtex/fiber and the average fiber diameter was about 25 μm. When the fineness and the average fiber diameter of this acrylamide-based polymer fiber (f-3) were measured in the same manner as in Production Example 1, the fineness was 6.8 dtex/fiber and the average fiber diameter was 26 μm.

<Production of Thermally-Stabilized Fiber>

A carbon fiber precursor fiber bundle (f-3) (1500 fibers/bundle) and a thermally-stabilized fiber bundle (f-3)(12000 fibers/bundle) were produced in the same manner as in Production Example 1 except that the acrylamide-based polymer fiber (f-3) was used instead of the acrylamide-based polymer fiber (f-1), the temperature during drawing was changed to 260° C., and the draw ratio was changed to 4. When the single fiber fineness and the average fiber diameter of this thermally-stabilized fiber bundle (f-3) were measured in the same manner as in Production Example 1, the fineness was 1.1 dtex/fiber and the average fiber diameter was 10 μm.

Production Example 4

<Production of Acrylamide-Based Polymer Fiber>

An acrylamide-based polymer fiber (f-4) was produced in the same manner as in Production Example 2 except that the AM/AN/AA copolymer (AM/AN/AA=65 mol %/33 mol %/2 mol %) obtained in Preparation Example 3 was used instead of the AM/AN copolymer (AM/AN=75 mol %/25 mol %) obtained in Preparation Example 1, and dry spinning was performed so that the fineness of the acrylamide-based polymer fiber was about 2 dtex/fiber and the average fiber diameter was about 14 μm. When the fineness and the average fiber diameter of this acrylamide-based polymer fiber (f-4) were measured in the same manner as in Production Example 1, the fineness was 2.3 dtex/fiber and the average fiber diameter was 15 μm.

<Production of Thermally-Stabilized Fiber>

A carbon fiber precursor fiber bundle (f-4) (1500 fibers/bundle) and a thermally-stabilized fiber bundle (f-4) (12000 fibers/bundle) were produced in the same manner as in Production Example 1 except that the acrylamide-based polymer fiber (f-4) was used instead of the acrylamide-based polymer fiber (f-1), the temperature during drawing was changed to 260° C., and the draw ratio was changed to 4. When the single fiber fineness and the average fiber diameter of this thermally-stabilized fiber bundle (f-4) were measured in the same manner as in Production Example 1, the fineness was 0.4 dtex/fiber and the average fiber diameter was 6 μm.

Production Example 5

<Production of Acrylamide-Based Polymer Fiber>

An acrylamide-based polymer fiber (f-5) was produced in the same manner as in Production Example 4 except that 3 parts by mass of diammonium hydrogen phosphate was added to 100 parts by mass of the AM/AN/AA copolymer instead of phosphoric acid. When the fineness and the average fiber diameter of this acrylamide-based polymer fiber (f-5) were measured in the same manner as in Production Example 1, the fineness was 2.0 dtex/fiber and the average fiber diameter was 14 μm.

<Production of Thermally-Stabilized Fiber>

A carbon fiber precursor fiber bundle (f-5) (1500 fibers/bundle) and a thermally-stabilized fiber bundle (f-5) (12000 fibers/bundle) were produced in the same manner as in Production Example 1 except that the acrylamide-based polymer fiber (f-5) was used instead of the acrylamide-based polymer fiber (f-1), the temperature during drawing was changed to 260° C., and the draw ratio was changed to 4. When the single fiber fineness and the average fiber diameter of this thermally-stabilized fiber bundle (f-5) were measured in the same manner as in Production Example 1, the fineness was 0.4 dtex/fiber and the average fiber diameter was 6 μm.

Example 1

The thermally-stabilized fiber bundle (f-1) obtained in Production Example 1 was moved in a nitrogen atmosphere having a temperature gradient of 300° C. to 900° C. during a period of 3 minutes while a tension of 0.09 mN/dtex was applied to the thermally-stabilized fiber bundle (f-1) to perform heating treatment (pre-carbonizing treatment) to obtain a pre-carbonized fiber bundle (12000 fibers/bundle), and subsequently, the pre-carbonized fiber bundle was moved in a nitrogen atmosphere having a temperature gradient of 1300° C. to 1700° C. during a period of 3 minutes to perform heating treatment (carbonizing treatment) to produce a carbon fiber bundle (12000 fibers/bundle).

Example 2

A pre-carbonized fiber bundle (12000 fibers/bundle) was produced, and further, a carbon fiber bundle (12000 fibers/bundle) was produced in the same manner as in Example 1 except that the thermally-stabilized fiber bundle (f-2) obtained in Production Example 2 was used instead of the thermally-stabilized fiber bundle (f-1) obtained in Production Example 1 and the tension applied during the pre-carbonizing treatment was changed to 0.15 mN/dtex.

Example 3

A pre-carbonized fiber bundle (12000 fibers/bundle) was produced, and further, a carbon fiber bundle (12000 fibers/bundle) was produced in the same manner as in Example 1 except that the thermally-stabilized fiber bundle (f-3) obtained in Production Example 3 was used instead of the thermally-stabilized fiber bundle (f-1) obtained in Production Example 1 and the tension applied during the pre-carbonizing treatment was changed to 0.15 mN/dtex.

Example 4

A pre-carbonized fiber bundle (12000 fibers/bundle) was produced, and further, a carbon fiber bundle (12000 fibers/bundle) was produced in the same manner as in Example 1 except that the thermally-stabilized fiber bundle (f-4) obtained in Production Example 4 was used instead of the thermally-stabilized fiber bundle (f-1) obtained in Production Example 1 and the tension applied during the pre-carbonizing treatment was changed to 0.33 mN/dtex.

Example 5

A pre-carbonized fiber bundle (12000 fibers/bundle) was produced, and further, a carbon fiber bundle (12000 fibers/bundle) was produced in the same manner as in Example 1 except that the thermally-stabilized fiber bundle (f-5) obtained in Production Example 5 was used instead of the thermally-stabilized fiber bundle (f-1) obtained in Production Example 1 and the tension applied during the pre-carbonizing treatment was changed to 0.42 mN/dtex.

Example 6

A pre-carbonized fiber bundle (12000 fibers/bundle) was produced, and further, a carbon fiber bundle (12000 fibers/bundle) was produced in the same manner as in Example 1 except that the thermally-stabilized fiber bundle (f-4) obtained in Production Example 4 was used instead of the thermally-stabilized fiber bundle (f-1) obtained in Production Example 1 and the tension applied during the pre-carbonizing treatment was changed to 1.04 mN/dtex.

Example 7

A pre-carbonized fiber bundle (12000 fibers/bundle) was produced, and further, a carbon fiber bundle (12000 fibers/bundle) was produced in the same manner as in Example 1 except that the thermally-stabilized fiber bundle (f-4)

obtained in Production Example 4 was used instead of the thermally-stabilized fiber bundle (f-1) obtained in Production Example 1 and the tension applied during the pre-carbonizing treatment was changed to 2.08 mN/dtex.

Comparative Example 1

A pre-carbonized fiber bundle (12000 fibers/bundle) was produced, and further, a carbon fiber bundle (12000 fibers/bundle) was produced in the same manner as in Example 1 except that the tension applied during the pre-carbonizing treatment was changed to 0.02 mN/dtex.

Comparative Example 2

A pre-carbonized fiber bundle (12000 fibers/bundle) was produced, and further, a carbon fiber bundle (12000 fibers/bundle) was produced in the same manner as in Example 1 except that the thermally-stabilized fiber bundle (f-4) obtained in Production Example 4 was used instead of the thermally-stabilized fiber bundle (f-1) obtained in Production Example 1 and the tension applied during the pre-carbonizing treatment was changed to 5.00 mN/dtex.

<Presence or Absence of Breakage of Fiber During Pre-Carbonizing Treatment>

A fiber bundle for evaluation having a length of 5 cm was cut out from each obtained pre-carbonized fiber bundle, and this fiber bundle for evaluation was observed using a microscope ("SKM-S20B-PC" manufactured by Saitou Kougaku Co., Ltd.) to evaluate the states of the pre-carbonized single fibers constituting the pre-carbonized fiber bundle in accordance with the following criterion. Table 1 shows the results.

A: The pre-carbonized single fibers were not broken.

B: 1 to 4 of the pre-carbonized single fibers were broken.

C: 5 or more of the pre-carbonized single fibers were broken.

<Raman Spectroscopic Analysis of Carbon Fiber>

Each obtained carbon fiber bundle was observed using a microscopic Raman spectrophotometer ("inVia Reflex/StreamLine" manufactured by Renishaw plc., a microscope: manufactured by Leica Camera AG, an object lens: 100-power, a detector: CCD (the number of channels: 1024×256)), and Raman spectroscopic analysis was performed on the cross sections perpendicular to the fiber axis directions of randomly extracted single fibers under conditions of a laser wavelength of 532 nm, a diffraction grating of 1800 lines/mm, and a resolution of 0.6 μm to obtain Raman mapping images. Note that when the Raman spectroscopic analysis was performed on randomly extracted 5 to 6 single fibers, the same Raman mapping images were obtained in any case.

Based on the Raman mapping image of the cross section of the single fiber, an average value of a ratio (D/G) of the intensity of the D peak to the intensity of the G peak in the Raman spectrum in each of a region (center portion) inside a circle having a diameter of 1 μm and centered at a center of gravity of the cross section of the single fiber and a region (surface portion) up to 1 μm inside from an outer periphery of the cross section of the single fiber was determined, wherein the D peak is observed at around 1360 $cm^{-1}$ and derived from a defect in a graphite structure and the G peak is observed at around 1590 $cm^{-1}$ and derived from the graphite structure. Table 1 shows the results. Note that as the peak intensity, an intensity determined by fitting in a mixed mode of Gaussian fitting and Lorentzian fitting was employed.

<Average Fiber Diameter of Carbon Fiber>

Regarding the obtained carbon fiber bundle, the side surface was observed using a microscope ("Digital Microscope VHX-1000" manufactured by KEYENCE CORPORATION), and a measurement point of the fiber diameter of each of 10 randomly extracted single fibers was randomly selected to measure the fiber diameters of the carbon fibers constituting the carbon fiber bundle, and the average value (the average fiber diameter of the carbon fiber) was determined. Table 1 shows the results.

<Tensile Strength of Carbon Fiber>

Single fibers were taken out from the obtained carbon fiber bundle, and a micro strain tester ("Micro Autograph MST-I" manufactured by Shimadzu Corporation) was used to perform a tensile test (gauge length: 25 mm, and tensile speed: 1 mm/min) at room temperature in accordance with JIS R7606 to measure the tensile strength and obtain the average value of 5 times. Table 1 shows the results.

TABLE 1

| | Thermally-stabilized Fiber Bundle | | | | | Pre-carbonizing Treatment | | | Carbon Fiber | | | |
|---|---|---|---|---|---|---|---|---|---|---|---|---|
| | Composition AM/AN/AA | Additive (Amount added*1) | Number of Single-Fibers [Fibers] | Single-Fiber Fineness [dtex] | Average Fiber Diameter [μm] | Max. Temp. [° C.] | Tension [mN/dtex] | Breakage | D/G value Center portion | D/G value Surface portion | Average Fiber Diameter [μm] | Tensile Strength [GPa] |
| Ex. 1 | 75/25/0 | None | 12000 | 1.4 | 11 | 900 | 0.09 | A | 0.88 | 0.87 | 8 | 2.7 |
| Ex. 2 | 75/25/0 | Phosphoric acid (3) | 12000 | 0.9 | 9 | 900 | 0.15 | A | 0.84 | 0.83 | 7 | 3.2 |
| Ex. 3 | 73/25/2 | Phosphoric acid (3) | 12000 | 1.1 | 10 | 900 | 0.15 | A | 0.84 | 0.83 | 7 | 3.6 |
| Ex. 4 | 65/33/2 | Phosphoric acid (3) | 12000 | 0.4 | 6 | 900 | 0.33 | A | 0.81 | 0.81 | 5 | 3.9 |
| Ex. 5 | 65/33/2 | Phosphate*2 (3) | 12000 | 0.4 | 6 | 900 | 0.42 | A | 0.77 | 0.80 | 5 | 4.3 |
| Ex. 6 | 65/33/2 | Phosphoric acid (3) | 12000 | 0.4 | 6 | 900 | 1.04 | B | 0.80 | 0.81 | 5 | 4.2 |
| Ex. 7 | 65/33/2 | Phosphoric acid (3) | 12000 | 0.4 | 6 | 900 | 2.08 | B | 0.84 | 0.84 | 5 | 3.2 |
| Comp. Ex. 1 | 75/25/0 | None | 12000 | 1.4 | 11 | 900 | 0.02 | A | 0.97 | 0.95 | 8 | 1.4 |
| Comp. Ex. 2 | 65/33/2 | Phosphoric acid (3) | 12000 | 0.4 | 6 | 900 | 5.00 | C | 0.93 | 0.88 | 5 | 2.2 |

*1Amount added relative to 100 parts by mass of the polymer [parts by mass]

*2Diammonium hydrogen phosphate

As shown in Table 1, it was found that in the case where the thermally-stabilized fiber of the acrylamide-based polymer fiber was subjected to pre-carbonizing treatment while a predetermined tension was applied thereto under an inert gas atmosphere (Examples 1 to 7), a carbon fiber could be obtained in which the average value of the intensity ratio (D/G) of the D peak to the G peak in the Raman spectrum was within the predetermined range in both of the center portion and the surface portion in the cross section of the single fiber. In addition, it was found that the carbon fiber was excellent in tensile strength.

On the other hand, it was found that in the case where the tension applied during the pre-carbonizing treatment was smaller than the predetermined range (Comparative Example 1), the obtained carbon fiber had a larger average value of the intensity ratio (D/G) of the D peak to the G peak in the Raman spectrum than the predetermined range in both of the center portion and the surface portion in the cross section of the single fiber, and had a poor tensile strength. In addition, it was found that in the case where the tension applied during the pre-carbonizing treatment was larger than the predetermined range (Comparative Example 2), the obtained carbon fiber had a larger average value of the intensity ratio (D/G) of the D peak to the G peak in the Raman spectrum than the predetermined range in the center portion in the cross section of the single fiber, and was poor in tensile strength.

In addition, from a comparison between Example 4 and Example 5, it was found that there was a tendency that the larger the tension applied during the pre-carbonizing treatment was, the smaller the average value of the intensity ratio (D/G) of the D peak to the G peak in the Raman spectrum in both of the center portion and the surface portion in the cross section of the single fiber of the obtained carbon fiber was, and the tensile strength was improved. However, as is clear from the results of Examples 6 to 7, it was found that there was a tendency that the larger the tension applied during the pre-carbonizing treatment was, the more likely the breakage of the fiber was to occur during the pre-carbonizing treatment.

As described above, the present invention makes it possible to obtain a carbon fiber having excellent tensile strength. Such a carbon fiber of the present invention is excellent in various properties such as light weight, rigidity, strength, elastic modulus, and corrosion resistance, and thus can be widely used as materials for various purposes such as aviation materials, space materials, automobile materials, pressure vessels, civil engineering and building materials, robot materials, communication equipment materials, medical materials, electronic materials, wearable materials, windmills, and sports equipment including golf shafts and fishing rods.

What is claimed is:

1. A carbon fiber derived from an acrylamide-based polymer fiber, wherein the acrylamide-based polymer is at least one selected from the group consisting of a homopolymer of an acrylamide-based monomer and a copolymer of an acrylamide-based monomer having a content of an acrylamide-based monomer units of 40 mol % or more and 99.9 mol % or less, an average fiber diameter of a single fiber is in a range of 3 to 10 μm, and an average value of an intensity ratio (D/G) of a D peak to a G peak in a Raman spectrum in a cross section perpendicular to a fiber axis direction of the single fiber is 0.90 or less in a region inside a circle having a diameter of 1 μm and centered at a center of gravity of the cross section of the single fiber, and is 0.90 or less in a region up to 1 μm inside from an outer periphery of the cross section of the single fiber, wherein the D peak is observed at around 1360 $cm^{-1}$ and derived from a defect in a graphite structure and the G peak is observed at around 1590 $cm^{-1}$ and derived from the graphite structure.

2. The carbon fiber according to claim 1, wherein the average value of the D/G is 0.85 or less in the region inside the circle having a diameter of 1 μm and centered at the center of gravity of the cross section of the single fiber, and is 0.85 or less in the region up to 1 μm inside from the outer periphery of the cross section of the single fiber.

3. A method for producing a carbon fiber, comprising:

a pre-carbonizing treatment step of obtaining a pre-carbonized fiber by subjecting a thermally-stabilized fiber of an acrylamide-based polymer fiber to heating treatment at a temperature in a range of 300 to 1000° C. while applying a tension in a range of 0.05 to 4 mN/dtex thereto under an inert gas atmosphere; and a carbonizing treatment step of obtaining a carbon fiber by subjecting the pre-carbonized fiber to heating treatment, wherein the acrylamide-based polymer is at least one selected from the group consisting of a homopolymer of an acrylamide-based monomer and a copolymer of an acrylamide-based monomer having a content of an acrylamide-based monomer units of 40 mol % or more and 99.9 mol % or less.

4. The method for producing a carbon fiber according to claim 3, wherein in the pre-carbonizing treatment step, the tension applied to the thermally-stabilized fiber is in a range of 0.15 to 1.5 mN/dtex.

* * * * *